US012035791B2

(12) United States Patent
Storey

(10) Patent No.: US 12,035,791 B2
(45) Date of Patent: Jul. 16, 2024

(54) AUTOMATICALLY OPENING BOX

(71) Applicant: Sherrill, Inc., Greensboro, NC (US)

(72) Inventor: Michael T Storey, Wimborne (GB)

(73) Assignee: Sherrill, Inc., Greensboro, NC (US)

( * ) Notice: Subject to any disclaimer, the term of this patent is extended or adjusted under 35 U.S.C. 154(b) by 61 days.

(21) Appl. No.: 18/168,147

(22) Filed: Feb. 13, 2023

(65) Prior Publication Data

US 2023/0255332 A1 Aug. 17, 2023

(30) Foreign Application Priority Data

Feb. 14, 2022 (GB) ..... 2201899

(51) Int. Cl.
*A45C 7/00* (2006.01)
*A45C 13/00* (2006.01)
*A45C 13/02* (2006.01)

(52) U.S. Cl.
CPC ..... *A45C 7/0063* (2013.01); *A45C 13/007* (2013.01); *A45C 13/02* (2013.01)

(58) Field of Classification Search
CPC ..... A45C 7/0063; A45C 13/007; A45C 13/02; A45C 7/0036; B65D 11/186
See application file for complete search history.

(56) References Cited

U.S. PATENT DOCUMENTS 680,186 A * 8/1901 Van Wormer ..... B65D 5/36 206/518
728,749 A * 5/1903 McCord ..... B65D 5/3642 229/117.26
7,699,212 B2 4/2010 Turvey et al.
8,146,763 B2 * 4/2012 Turvey ..... B65D 11/186 220/666
8,826,704 B1 * 9/2014 Marshall ..... E05G 1/10 211/64

(Continued)

FOREIGN PATENT DOCUMENTS

CN 110466864 A 11/2019
DE 10113176 10/2002

OTHER PUBLICATIONS

Extended European Search Report for Appl. No. EP23156205 dated Jun. 27, 2023.

*Primary Examiner* — Don M Anderson
*Assistant Examiner* — Justin Caudill
(74) *Attorney, Agent, or Firm* — Altman & Martin; Steven K Martin

(57) ABSTRACT

An automatically opening box comprising a rectangular base formed from two rectangular panels joined by a foldable spine. A pair of opposed sides extend upwardly from the base at base corners perpendicular to the spine, each having a vertical fold aligned with the spine. A pair of opposed sides extend upwardly from edges of the base at base corners parallel to the spine. Adjacent sides are connected at side corners. At least two side corners include sprung hinges. Both sides of one of the pairs of opposed sides having diagonal folds. The box has a collapsed configuration where both pairs of opposed sides are folded down to be parallel to the base, the base is folded along the spine and vertical folds, and a fastener secures the box in the collapsed configuration, and a deployed configuration where the fastener is released and the sprung hinges deploy the sides and base.

13 Claims, 15 Drawing Sheets

(56) References Cited

U.S. PATENT DOCUMENTS

| | | | | |
|---|---|---|---|---|
| 11,117,707 | B1 | 9/2021 | Song et al. | |
| 2006/0231692 | A1 | 10/2006 | Sabounijian | |
| 2010/0059531 | A1* | 3/2010 | Smith ..... | B65D 5/46016 220/666 |
| 2022/0002031 | A1 | 1/2022 | Calhoun | |

* cited by examiner

AUTOMATICALLY OPENING BOX

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to arborist throwline storage, more particularly, to a box for storing a throwline and throw weights.

2. Description of the Related Art

A modern arborist relies on a throwline and throw weight to install their climbing system prior to working at height. This mitigates the need to use heavy and dangerous ladder configurations. A throwline should be stored in a coiled manner to allow for tangle free deployment.

Historically, throwlines have been stored in open containers, bags, boxes, or buckets and also on a reel, all of which have inherent flaws due to space required in transport, ease of use, and due to the problem of the throwlines becoming entangled when stored in this way.

BRIEF SUMMARY OF THE INVENTION

The present invention is a storage box for a throwline that is collapsible and that opens automatically for deployment of the throwline.

The box has a rectangular base formed from two rectangular base panels joined at a foldable spine. Pairs of opposed sides extend upwardly from each edge of the base. One pair are perpendicular to the spine and the other pair are parallel to the spine. The sides are connected to the base and each other by foldable corners to define an open top box. Each of the perpendicular sides has a vertical fold aligned with the spine. Each side of one pair has a diagonal fold defined by substantially rigid panels and the other pair do not have diagonal folds. The panels are substantially rigid to define the shape of the box and to provide a solid structure suitable for carrying a throwline. Optionally, the base and sides are sheathed by a cover composed of a flexible material. The panels reside in pockets formed in the cover.

In a living hinge embodiment, the corners and folds are living hinges between adjacent panels. In a cover embodiment, the corners and folds are formed by the cover between panels defined by stitching that also forms the pockets.

The width of the spine vertical folds define the storage capacity of the box when in the collapsed configuration. Ideally, the spine width is the minimum necessary to accommodate the expected throwline and weights. The spine width is determined by the gap between the base panels. With the living hinge embodiment, the spine is a narrow strip of panel material attached on opposed sides to the base panels by living hinges. In the cover embodiment, the spine width is determined by the distance between two spaced lines of the stitching that form the base panel pockets.

Optionally, the outer surface of the base has feet. Optionally, the feet are eyelets or are attached by eyelets with holes for drainage.

Optionally, one or more throw weight pouches are provided on an inner surface of the box, preferably, in a corner of the box. The throw weight pouch may be defined by a piece of flexible material that is attached to one or more of the sides and/or the base.

Optionally, strips of reinforcing webbing attached to the cover by stitching can be employed at strategic locations to protect the cover from wear.

Sprung hinges are located at two or more of the corners so that the box opens automatically when a fastener is released. Each sprung hinge is comprised of a pair of hinge plates, a hinge pin, at least one torsion spring, and supporting rods. The hinge plates are connected together by the hinge pin through aligned hinge apertures to pivot about the hinge pin. The torsion spring(s) is captured by the hinge pin so that each of the spring arms is pushing against the inner face of the hinge plates to bias the hinge open.

The supporting rods extend from the hinge plates along the sides to provide support and unfold the sides. Each sprung hinge holds typically three rods. A first rod extends from a first hinge plate along the top edge of the non-folding side. Typically, the rod extends into a pocket at the top edge of the non-folding side. A second rod extends from a second hinge plate along the top edge of the folding side, typically in a pocket. Optionally, a third rod extends from the second hinge plate along the middle of the folding side, also in a pocket.

The fastener is arranged on the underside of the base so that it can secure the box in the collapsed configuration. The fastener may be a clip, buckle, hook, press stud, hook and loop, or ties, typically at the end of a strap.

Optionally, the outer face of the base and/or outer face of the sides has touch pads which direct a user to holding locations for deployment and holding locations for closure.

The throwline needs to be stored in a coiled manner. With the box in the deployed configuration, the coiled throwline is placed on the base and the throw weight(s) is placed in a throw weight pouch. The sides are folded down until they are parallel to the base, thereby covering and securing the throwline and throw weight(s). Once the sides are folded down, the vertical folds of the perpendicular sides are parallel to and aligned with spine. The box can be folded in half and the fastener engaged to secure the box in the collapsed configuration. When the fastener is disengaged, the sprung hinges automatically unfold the box to the deployed configuration.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
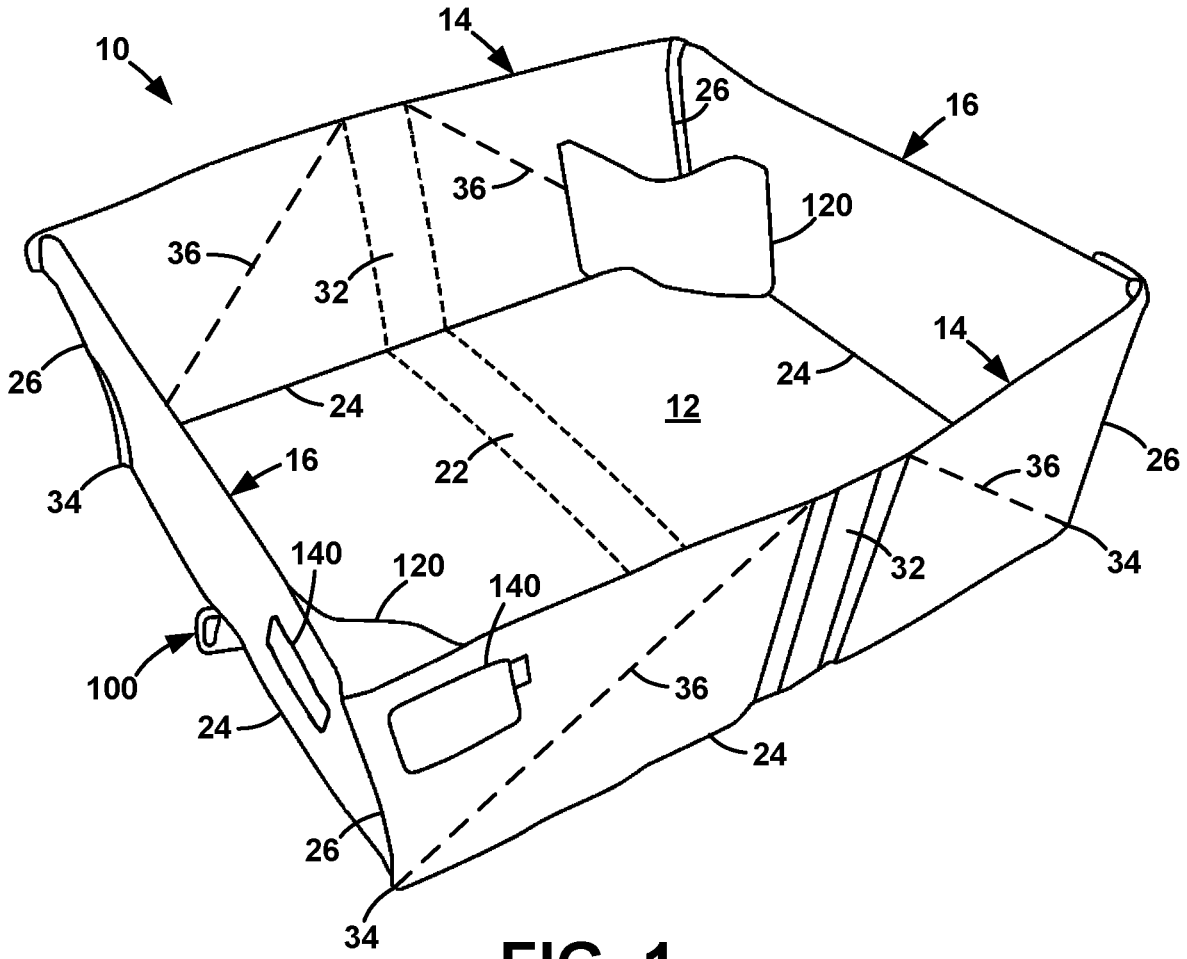
FIG. 1 shows a top perspective view of the box of the present invention in the deployed configuration with a first fold configuration.
Figure 2:
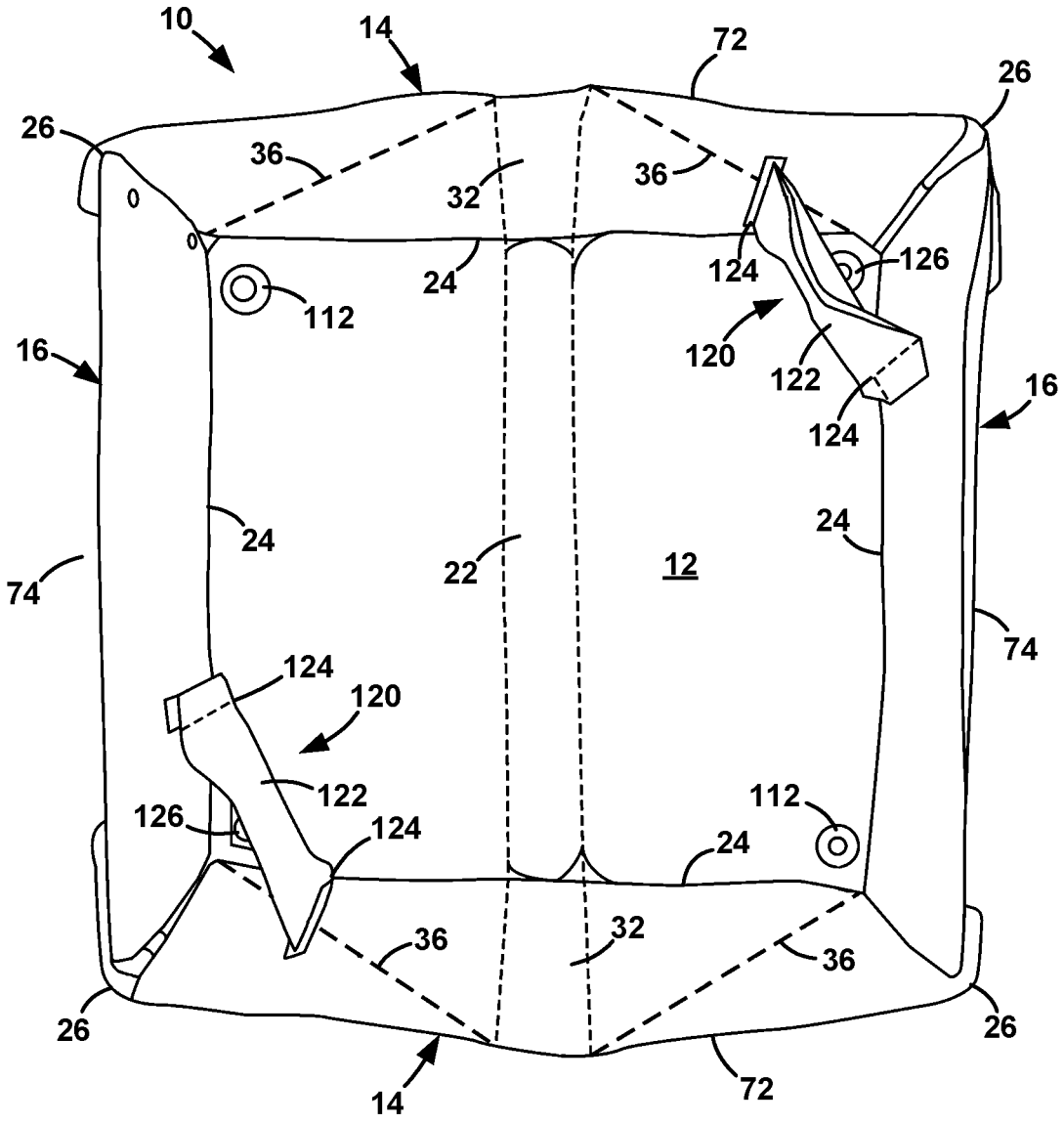
FIG. 2 shows a top view of the box with the first fold configuration of FIG. 1.

The present application hereby incorporates by reference in its entirety United Kingdom Patent Application No. 2201899.8, from which this application claims priority.

The present invention is a storage box 10 for a throwline that is collapsible and that opens automatically for deployment of the throwline.

The box 10 has a rectangular, foldable base 12 formed from two rectangular base panels 20 joined by a spine 22, as shown in FIGS. 1-4. The spine 22 is a flexible fold(s) that enables the base 12 to be repeatedly folded and unfolded. Preferably, the base 12 is square.

Pairs of opposed sides 14, 16 extend upwardly from each edge of the base 12. Each of one pair of opposed sides 14 are perpendicular to the spine 22 and each of the other pair of opposed sides 16 are parallel to the spine 22. The sides 14, 16 are connected to the base 12 by means of base corners 24 that fold, and adjacent sides 14, 16 are connected at side corners 26 that fold, all defining an open topped box.

Each side 14, 16 includes at least one substantially rigid side panel 30*a-i* (collectively, 30) to provide rigidity to the sides 14, 16 and to assist with defining fold lines that permit the box 10 to be collapsed. Preferably, the panels 30 are shaped to create fold lines so that a fold can be formed between adjacent panels 30 in order to fold the sides 14, 16 down until they are parallel with the base 12.

Each of the perpendicular sides 14 has a vertical fold 32 at the vertical bisection of the perpendicular side 14 that is aligned with the spine 22, the purpose of which is explained below.

Each side of one pair of opposed sides 14, 16, the folding sides 72, has a diagonal fold 36 extending upwardly from each base/wall corner 34 at a 45° angle, and the other pair of opposed sides 14, 16, the non-folding sides 74, do not have diagonal folds. In the configuration of FIGS. 1, 2, 5, and 6, the perpendicular sides 14 are the folding sides 72 and the parallel sides 16 are the non-folding sides 74. With this configuration, the perpendicular sides 14 are each comprised of right triangular panels 30*a*, 30*d* on the ends and two right trapezoidal panels 30*b*, 30*c* in the center. The parallel sides 16 are each comprised of a single rectangular panel 30*e*.

Figure 3:
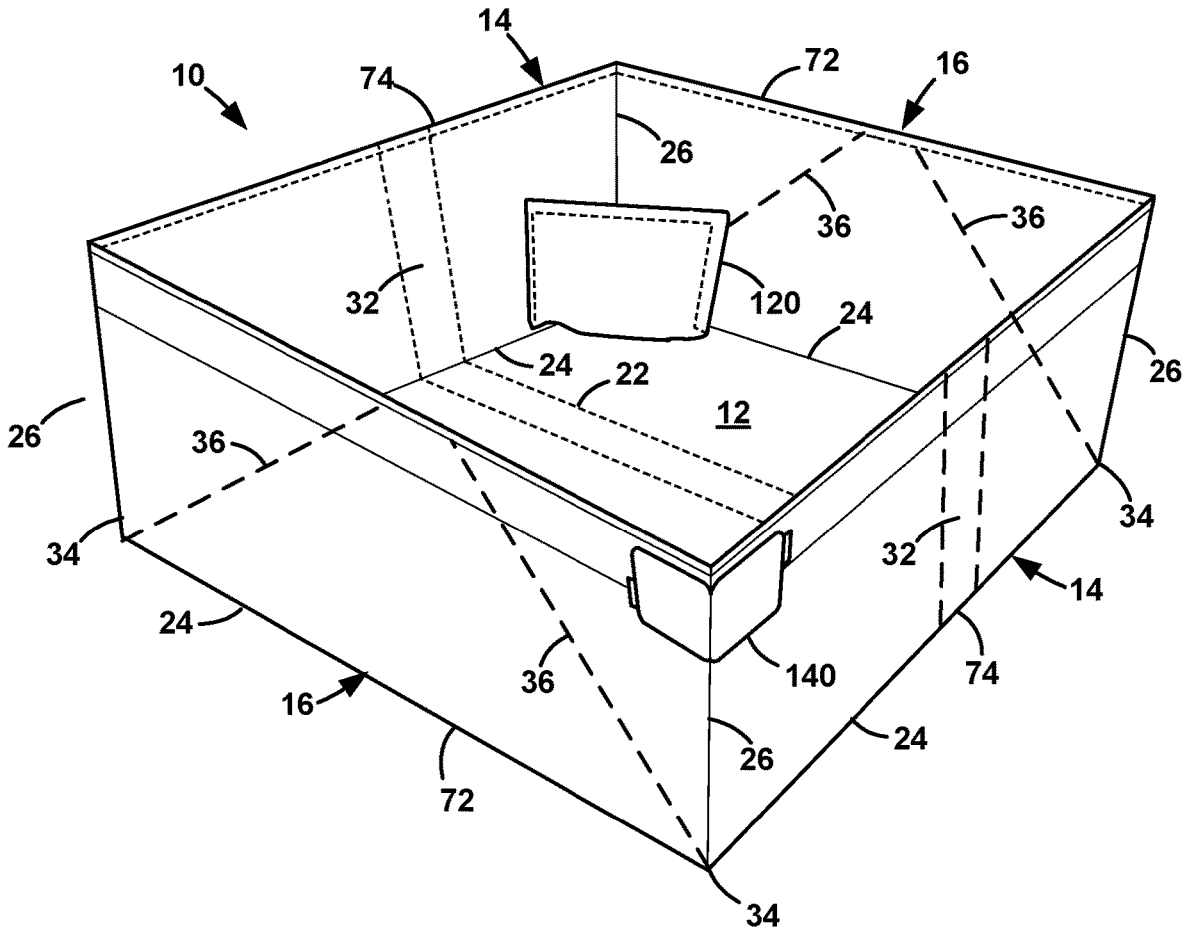
FIG. 3 shows a top perspective view of the box of the present invention in the deployed configuration with a second fold configuration.
Figure 4:
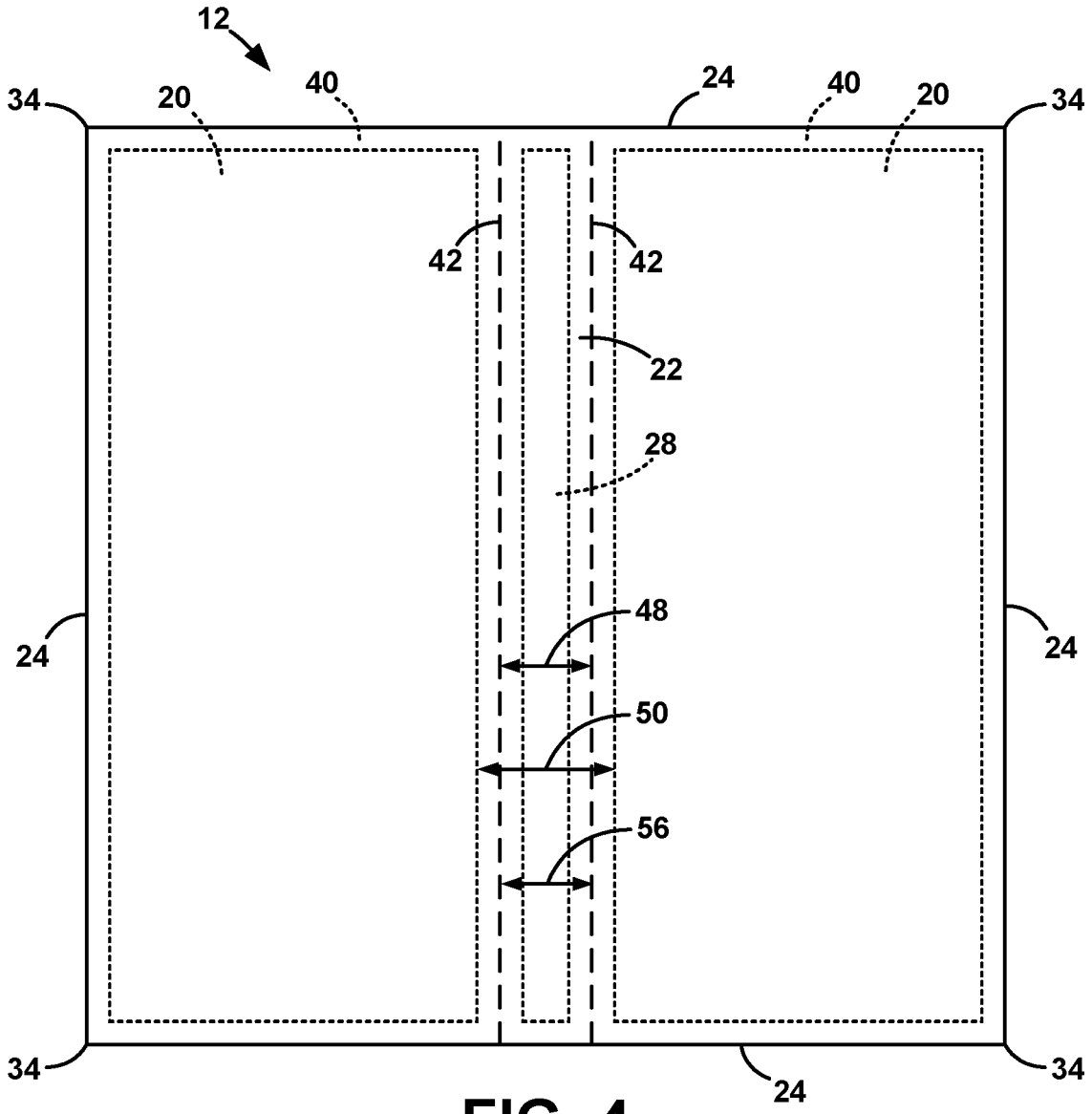
FIG. 4 shows a phantom view of the base.
Figure 5:
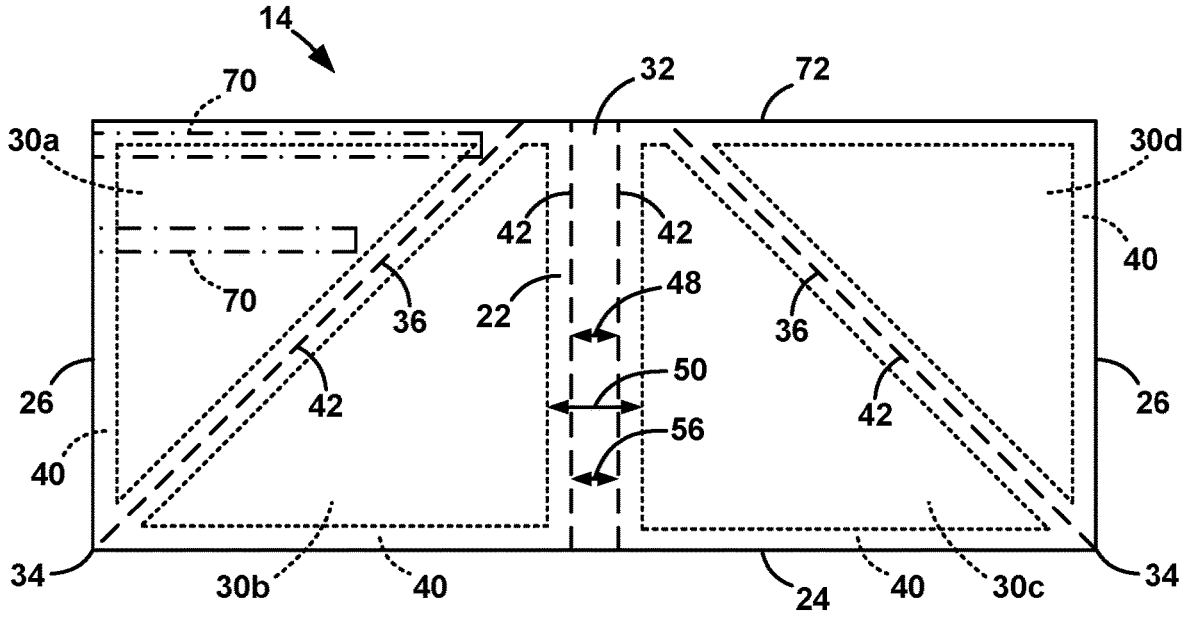
FIG. 5 shows a phantom view of a perpendicular side of the fold configuration of FIG. 1.
Figure 7:
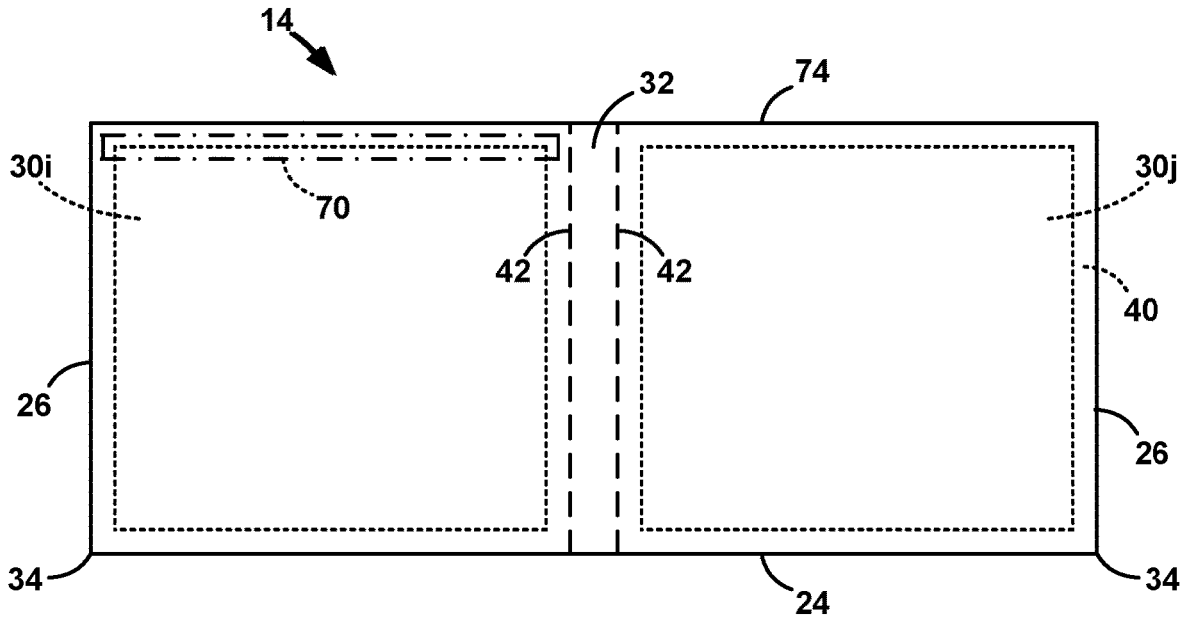
FIG. 7 shows a phantom view of a perpendicular side of the fold configuration of FIG. 3.
Figure 8:
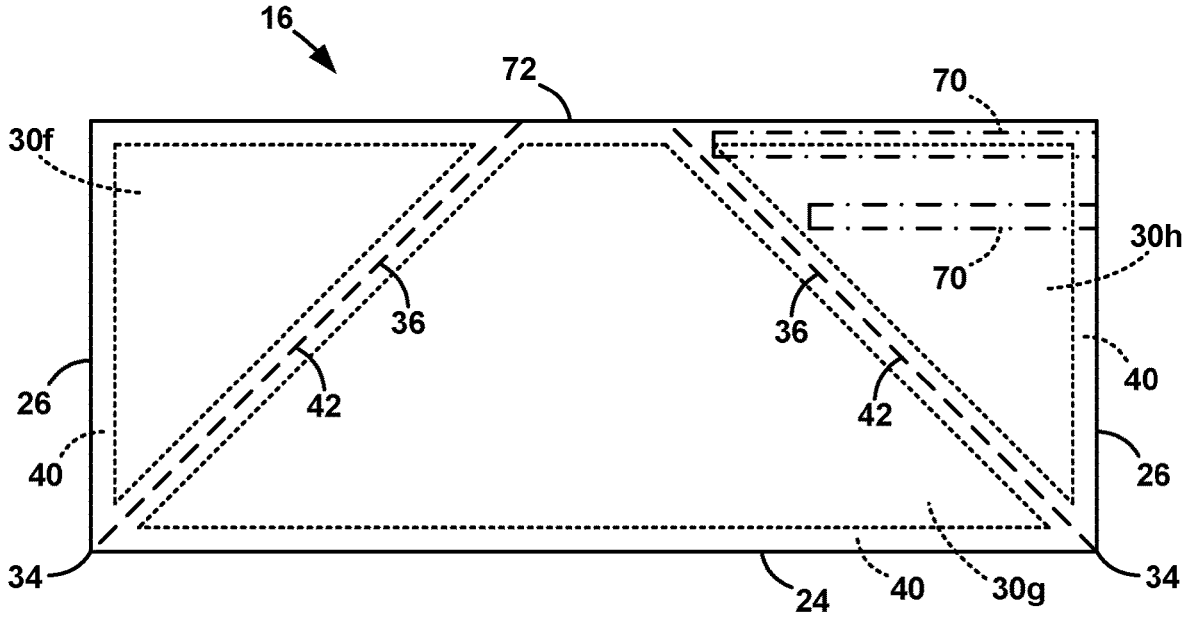
FIG. 8 shows a phantom view of a parallel side of the fold configuration of FIG. 3.

In the configuration of FIGS. 3, 7, and 8, the parallel sides 16 are the folding sides 72 and the perpendicular sides 14 are the non-folding sides 74. With this configuration, the parallel sides 16 are each comprised of right triangular panels 30*f*, 30*h* on the ends and a trapezoidal panel 30*g* in the center. The perpendicular sides are each comprised of a pair of rectangular panels 30*i*, 30*j*.

The box 10 can be collapsed in either of two ways. In the first, the folding sides 72 are folded down at the base corners 24, causing the diagonal folds 34 and the side corners 26 to fold. This then pulls the non-folding sides 74 down on top of the folding sides 74. In the other method, the non-folding sides 74 are folded down at the base corners 24, causing the diagonal folds 34 and the side corners 26 to fold, thereby pulling the folding sides 72 down on top of the non-folding sides 74.

It is appreciated that the dimensions of the sides 14, 16 relate to the maximum height of the box 10 due to the requirement that the sides 14, 16 fold down generally parallel to the base 12.

The panels 20, 30 are substantially rigid to define the shape of the box 10 and to provide a solid structure suitable for carrying a throwline. Typically, the panels 20, 30 are formed from synthetic plastics, so as to be strong, durable, and lightweight.

Optionally, the base 12 and sides 14 are sheathed by a cover 18 composed of a flexible, durable, rip-resistant material, such as a synthetic fabric such as a canvas. The panels 20, 30 reside in pockets 40 formed in the cover 18.

In a living hinge embodiment, the corners and folds are living hinges between adjacent panels 20, 30. A thin strip of panel material attaches adjacent panels 20, 30 to form the living hinge.

In a cover embodiment, the corners and folds are formed by the cover 18 between panels 20, 30. Stitching 42 divides the cover 18 into the pockets 40 for the panels 20, 30. The stitching 42 forces a gap 44 between the panels 20, 30 where the flexible material of the cover 18 can fold, thereby further defining the corners and folds.

It is appreciated that a combination of living hinges and cover hinges can be employed.

The width 48 of the spine 22 (and the aligned vertical folds 32) defines the storage capacity of the box 10 when in the collapsed configuration, as described below. For example, a wider spine 22 will provide space for a larger diameter throwline or stacked coils of throwline. Ideally, the spine width 48 is the minimum necessary to accommodate the expected throwline and weights. This is in order to minimize movement of the throwline when in the collapsed configuration so that the throwline is less likely to become tangled, and to keep overall size of the box 10 in the collapsed configuration as small as practical.

The spine width 48 is determined by the gap 50 between the base panels 20. With the living hinge embodiment, the spine 22 is a narrow strip of panel material attached on opposed sides to the base panels 20 by living hinges. In the cover embodiment, the spine width 48 is determined by the distance 56 between two spaced lines of the stitching 42 that form the base panel pockets 40. Optionally, a narrow panel 28 fits in the pocket between the lines of stitching.

Figure 9:
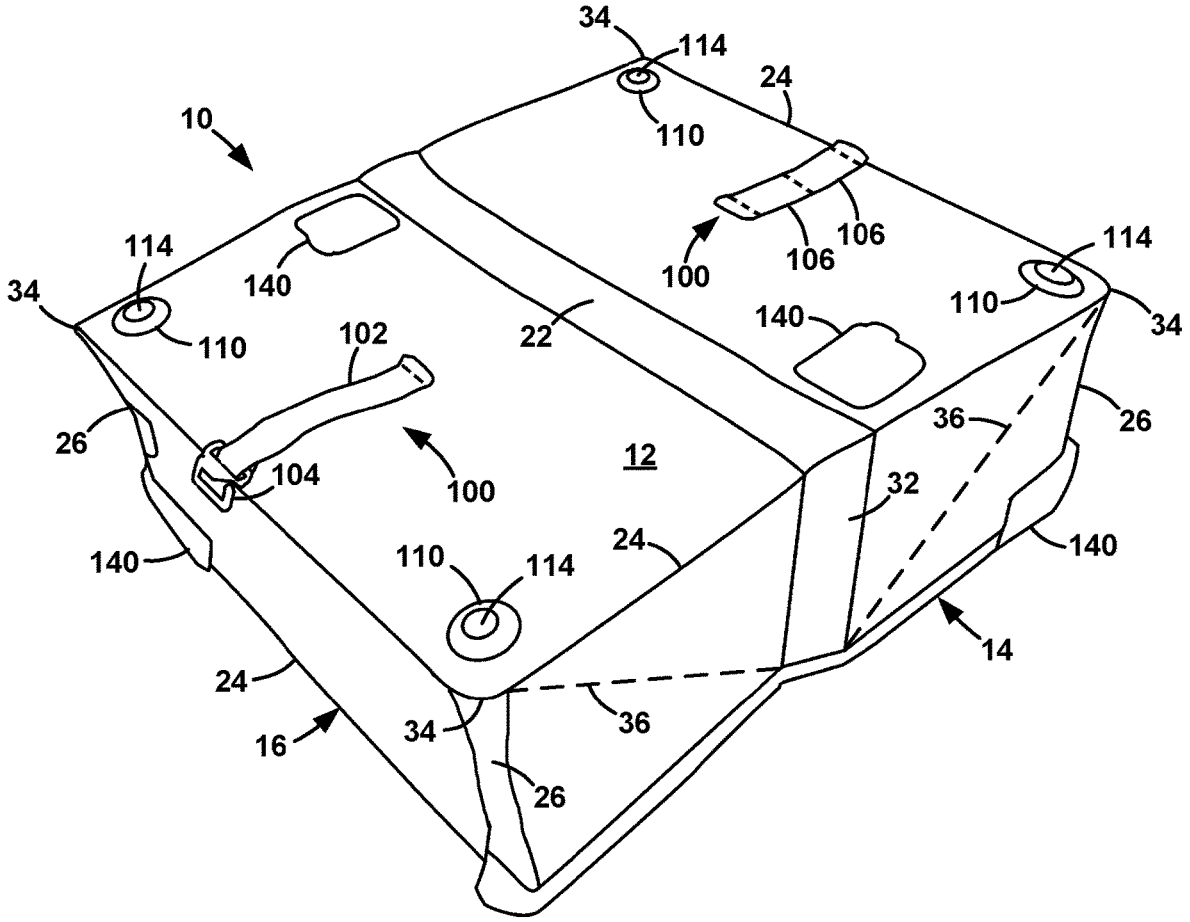
FIG. 9 shows a bottom perspective view of the box in the deployed configuration.
Figure 10:
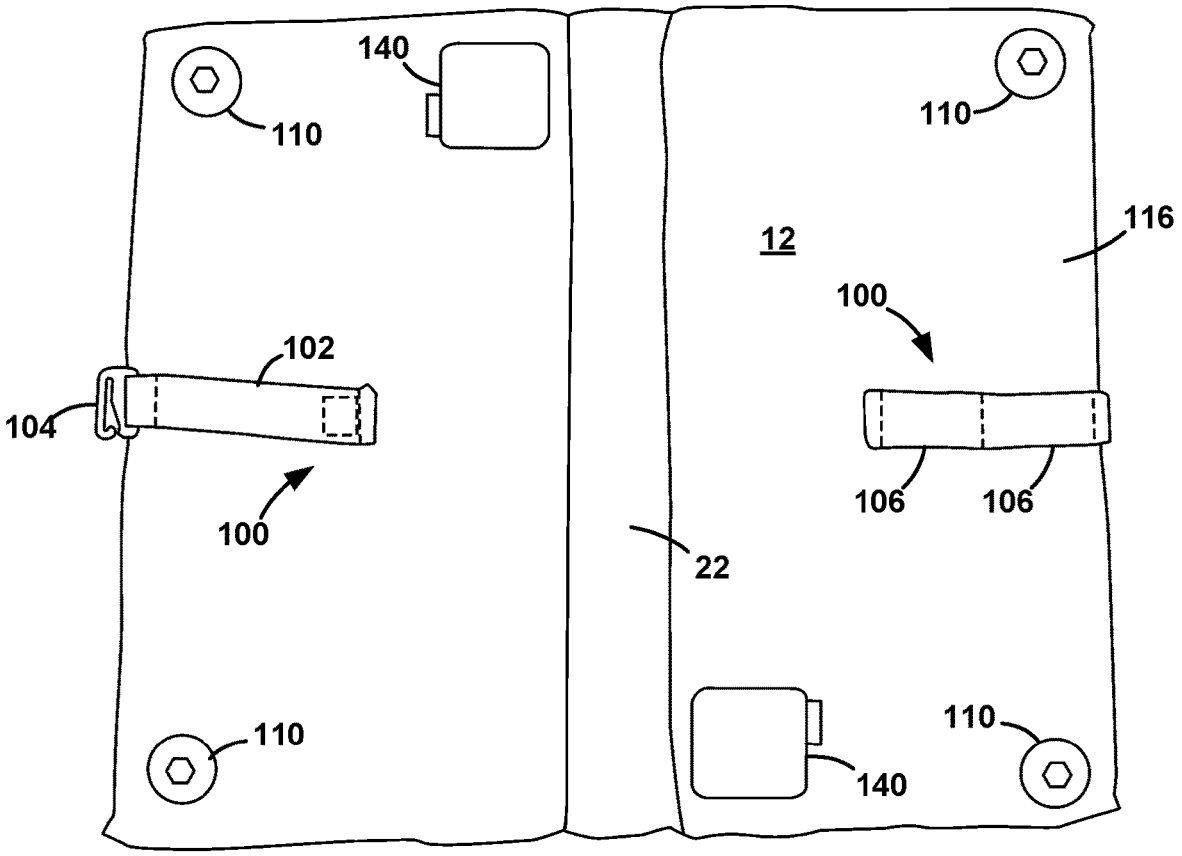
FIG. 10 shows a bottom view of the box in the deployed configuration.
Figure 11:
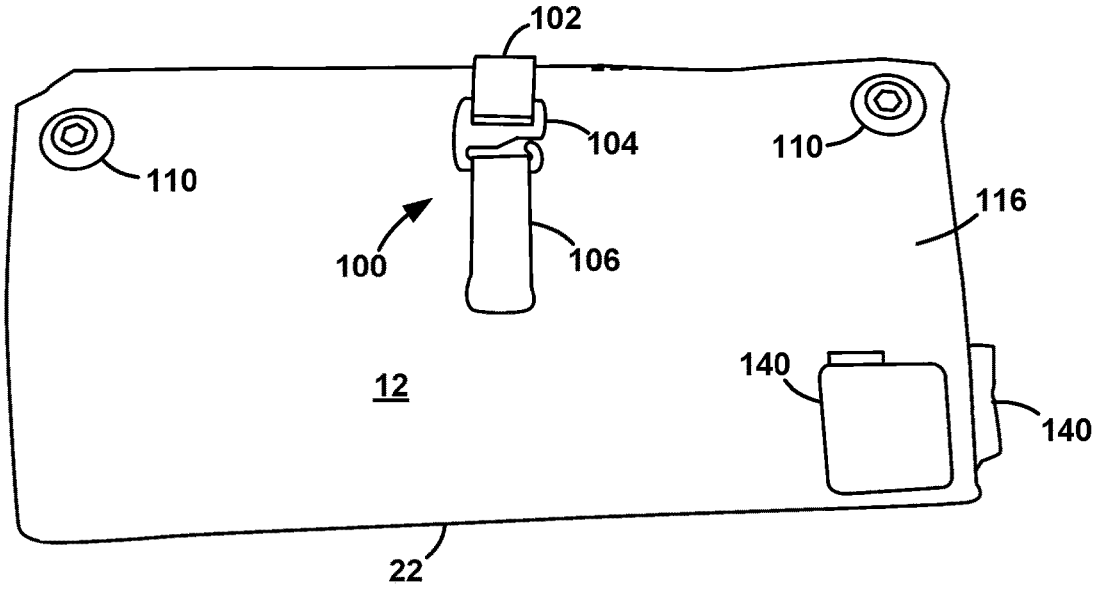
FIG. 11 shows the box in the collapsed configuration.

Optionally, the outer surface 116 of the base has feet 110, such as studs or patches, that elevate the box 10 from the ground so as to minimize wear, as shown in FIGS. 9-11. For example, the feet 110 may be formed from a strong, durable, anti-rip material such as synthetic plastics, rubber, or metal. Optionally, the feet 110 are eyelets 112 or are attached by eyelets 112 with holes 114 for drainage.

Optionally, one or more throw weight pouches 120 are provided on an inner surface of the box 10 for holding throw weights. Preferably, the throw weight pouch 120 is in a corner of the box 10. By having the weight in a corner, it is more securely located as the weight becomes held in the corner when the box 10 is collapsed.

Figure 12:
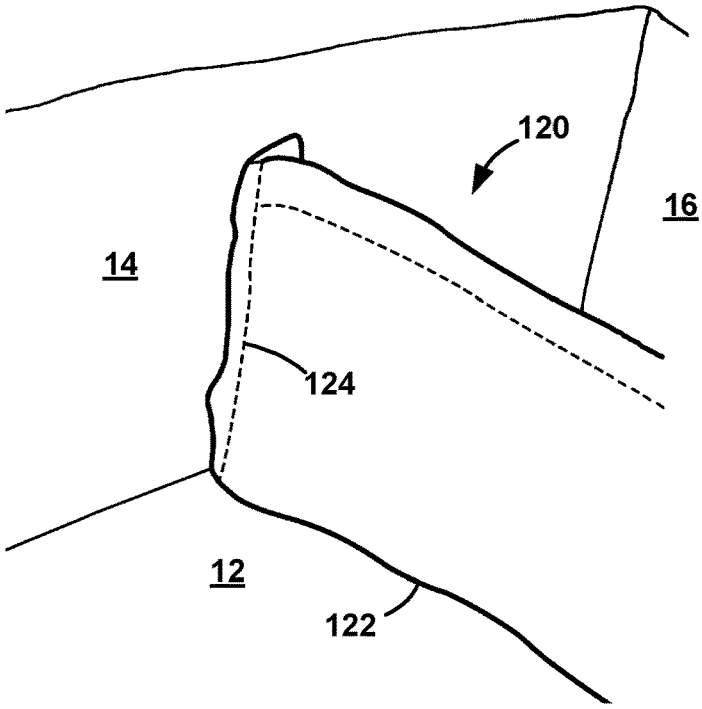
FIG. 12 shows details of the throw weight pocket.
Figure 13:
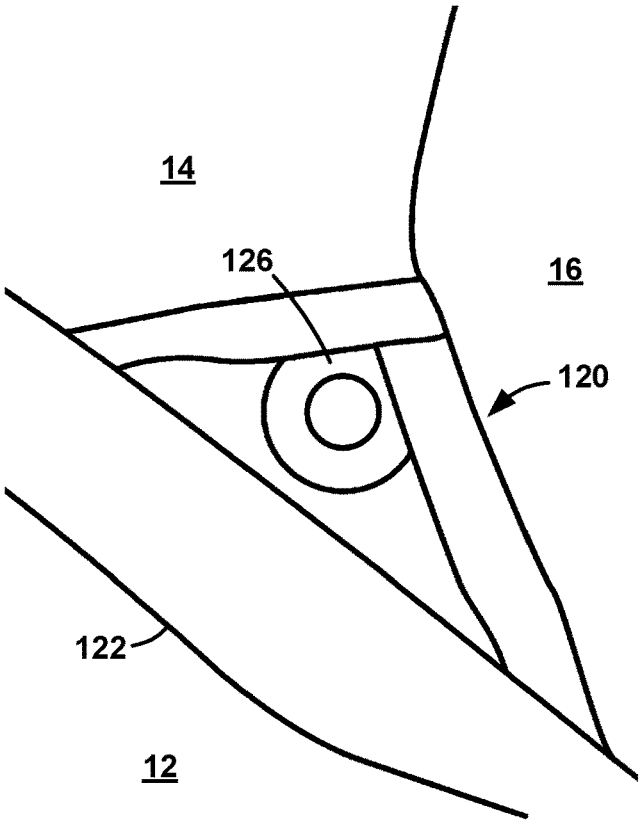
FIG. 13 shows details of the throw weight pocket.

The throw weight pouch 120 may be defined by a piece of flexible material 122 that is attached to one or more of the sides 14, 16, and/or the base 12. Typically, the material 122 is attached to the sides 14, 16, by stitching 124, as in FIG. 12. The material 122 may be secured to be base 12 by an eyelet 128, as in FIG. 13. The eyelet 124 provides a connection means, strength, and also provides a drainage point, and can double as the foot 110 and/or foot attachment.

Figure 14:
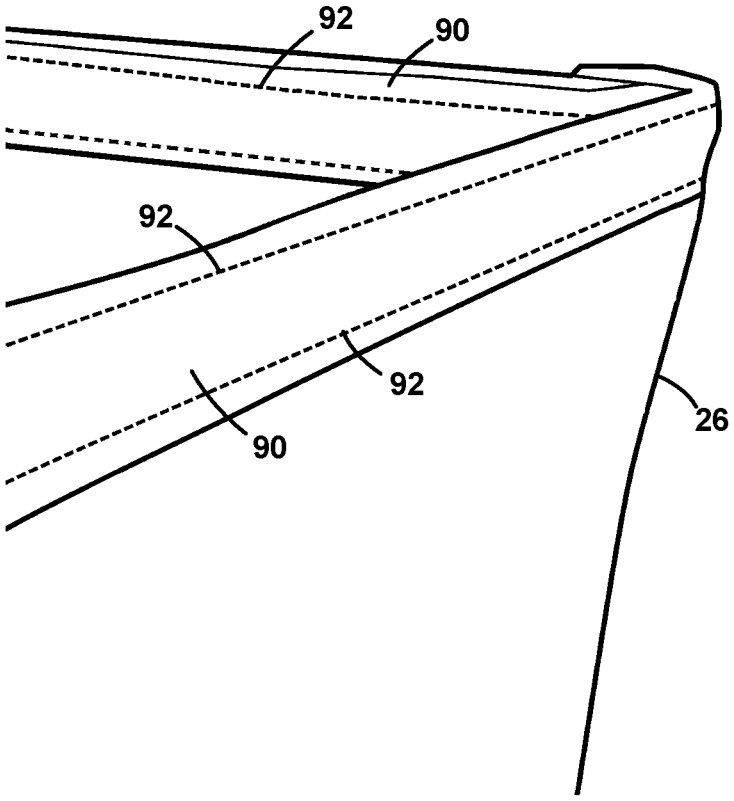
FIG. 14 shows details of an edge of a side.
Figure 15:
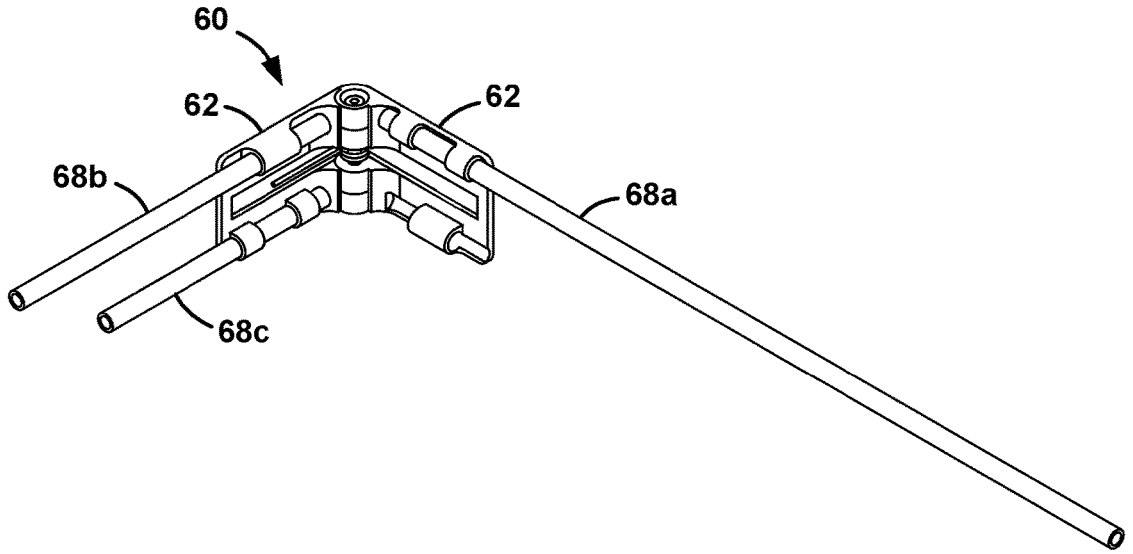
FIG. 15 shows the sprung hinge with rods.
Figure 16:
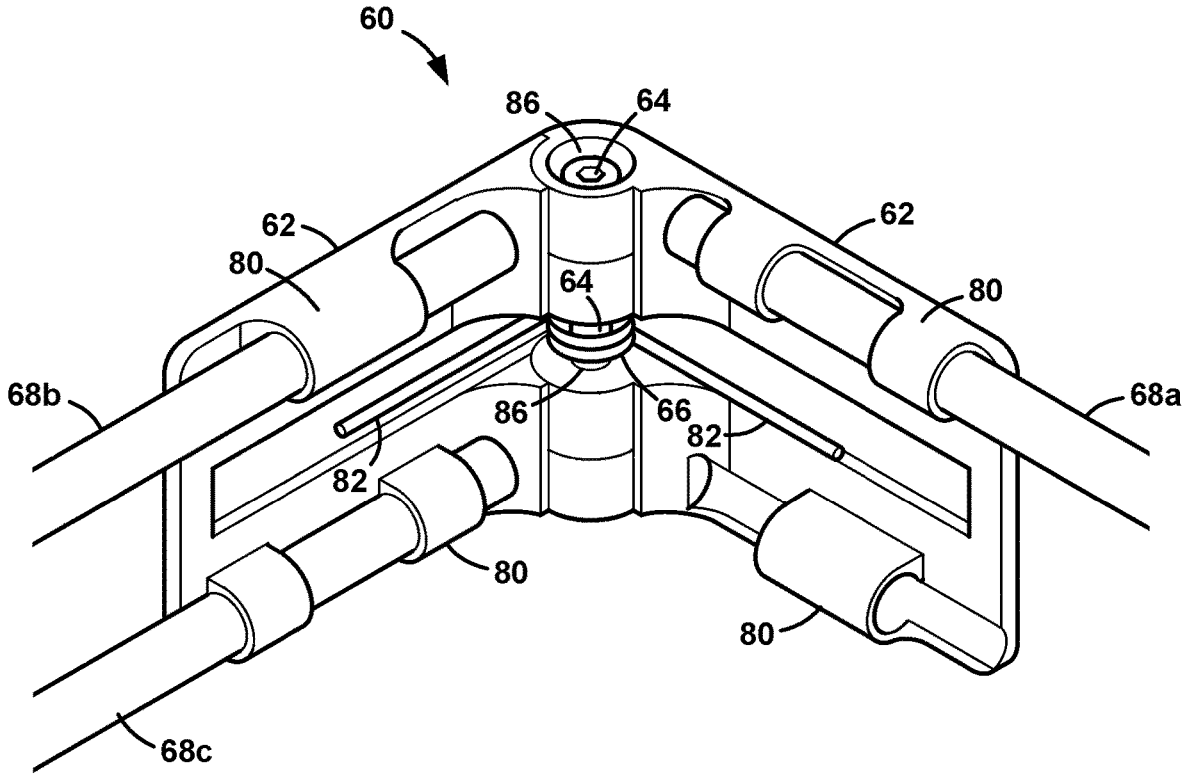
FIG. 16 shows details of the hinge.

Optionally, strips of reinforcing webbing 90 can be employed at strategic locations to protect the cover 18 from wear. For example, as shown in FIG. 14, upper edges of the sides 14, 16 may include reinforcing webbing 90 to protect against wear from the throwline passing over the edges. Parts of the base 12 that may contact the ground can include reinforcing webbing to reduce damage during use. The reinforcing webbing 90 is attached to the cover 18 by stitching 92.

So that the box 10 opens automatically when the fastener is released, at least two side corners 26, preferably, two opposed side corners 26, include sprung hinges 60. The sprung hinges 60 are biased to an open position so that, when the fastener 100, described below, is released, the sprung hinges 60 spring open, thereby deploying the sides 14, 16 and folded base 12.

Figure 17:
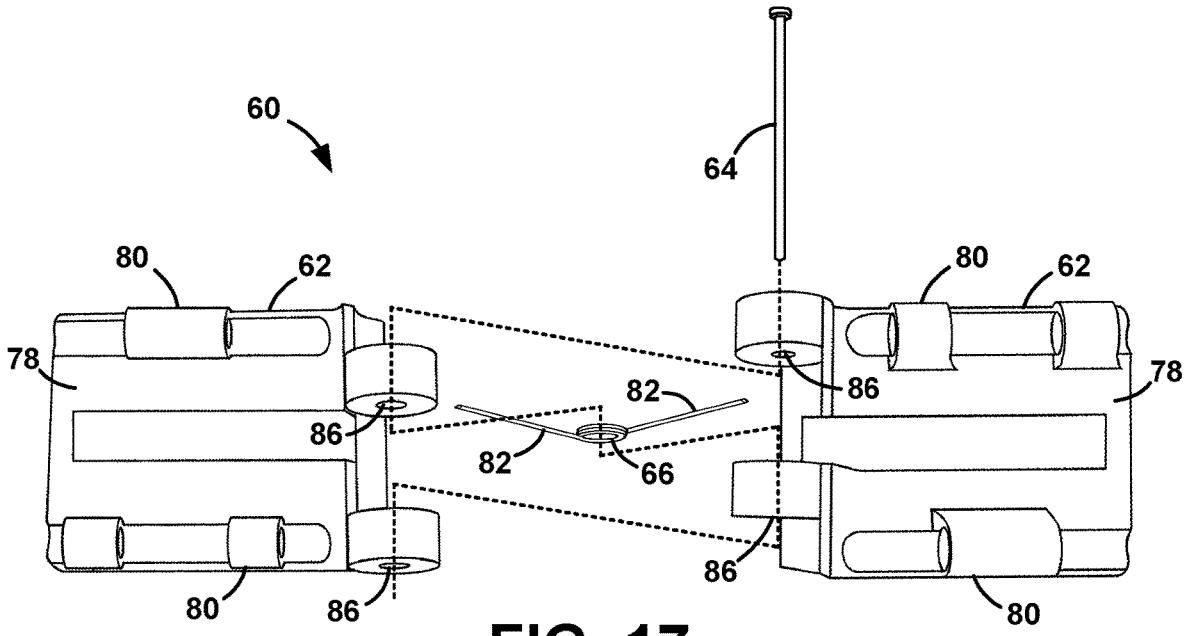
FIG. 17 shows a front view of the hinge plates.
Figure 18:
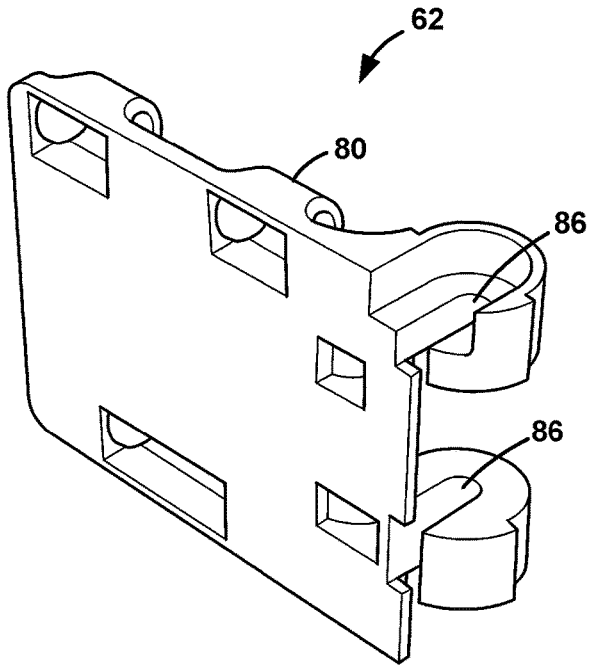
FIG. 18 shows a rear view of the hinge plate.

Preferably, each sprung hinge 60 is comprised of a pair of hinge plates 62*a*, 62*b* (collectively, 62), a hinge pin 64, at least one torsion spring 66, and supporting rods 68*a*, 68*b*, 68*c* (collectively, 68). The hinge plates 62, shown in FIGS. 17 and 18, can be identical and are connected together by the hinge pin 64 through aligned hinge apertures 86 to pivot about the hinge pin 64.

The torsion spring(s) 66 is captured by the hinge pin 64 so that each of the spring arms 82 is pushing against the inner face 78 of the hinge plates 62 to bias the hinge 60 open. An optional recess 84 helps retain the spring arms 82 in place. The torsion spring 66 is biased to at least 90° to correspond to the angle of the side corner 26 of the box 10. Optionally, the torsion spring 66 is biased to greater than 90° in order to provide additional tension into the side corners 26 to better maintain the box 10 open.

Figure 6:
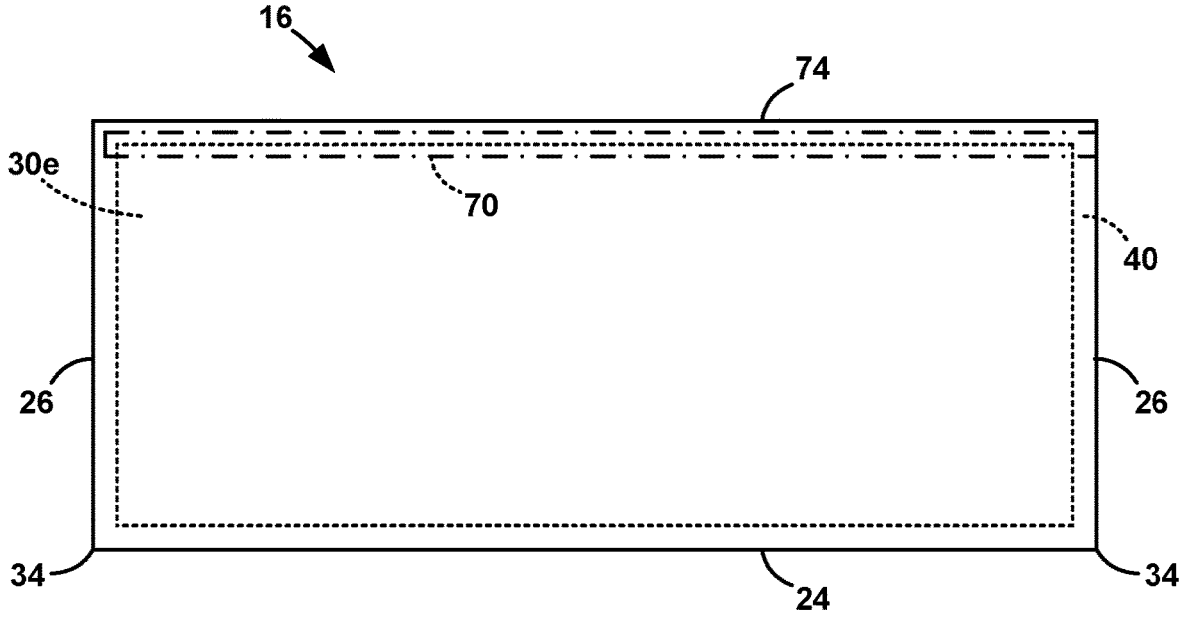
FIG. 6 shows a phantom view of a parallel side of the fold configuration of FIG. 1.

The supporting rods 68 extend from the hinge plates 62 along the sides 14, 16 in order to provide support and to unfold the sides 14, 16. Each sprung hinge 60 holds at least two, typically three, rods 68. A first rod 68*a* extends from a first hinge plate 62*a* along the top edge of the non-folding side 74. In the configuration of FIG. 6, the rod 68*a* extends the full length of the non-spine side 16. In the configuration of FIG. 7, the rod 68*a* extends up to, but not beyond, the vertical fold 32 of the spine side 14 so that the rod 68*a* does not prevent folding. Preferably, the rod 68*a* is fixed at the top edge of the non-folding side 74. One contemplated method is that the rod 68*a* extends in a pocket 70*a* at the top edge of the non-folding side 74.

A second rod 68*b* extends from a second hinge plate 62*b* along the top edge of the folding side 72. In both of the configurations of FIGS. 5 and 8, the rod 68*b* extends up to, but not beyond, the diagonal fold 36 so that the rod 68*b* does not prevent folding. Preferably, the rod 68*b* is fixed at the top end of the folding side 72. One contemplated method is that the rod 68*b* extends in a pocket 70*b* at the top edge of the folding side 72.

Optionally, a third rod 68*c* extends from the second hinge plate 62*b* along the middle of the folding side 72. In both of the configurations of FIGS. 5 and 8, the rod 68*c* extends up to, but not beyond, the diagonal fold 36 so that the rod 68*b* does not prevent folding. Because of the nature of the diagonal fold, the third rod 68*c* will be shorter than the second rod 68*b*.

Optionally, a fourth rod, not shown, extends from the first hinge plate 62*a* along the middle of the non-folding side 72. As with the first rod 68*a*, in the configuration of FIG. 6, the rod extends the full length of the non-spine side 16. In the configuration of FIG. 7, the rod extends up to, but not beyond, the vertical fold 32 of the spine side 14 so that the rod 68*a* does not prevent folding.

Figure 19:
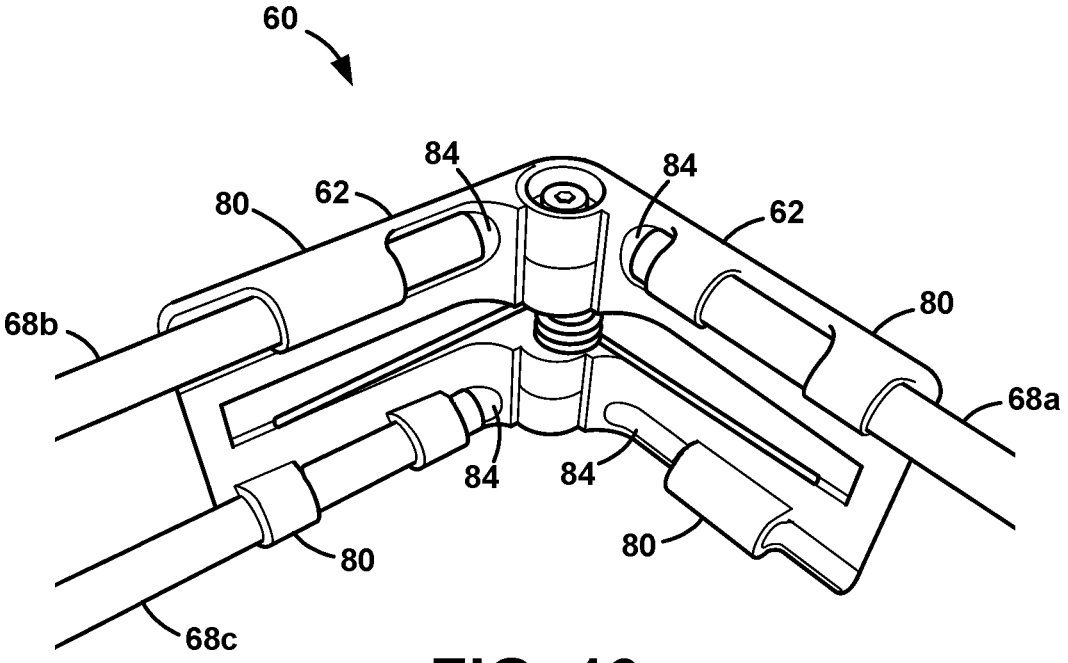
FIG. 19 shows details of the hinge.
Figure 20:
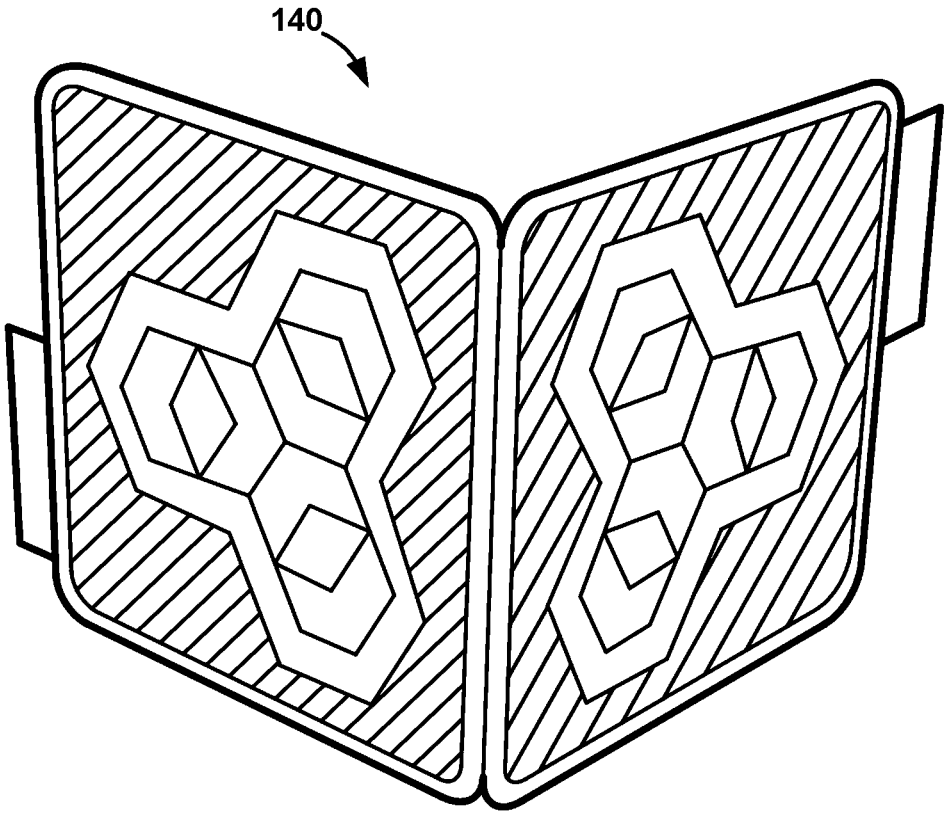
FIG. 20 shows a first configuration of the touch pad.
Figure 21:
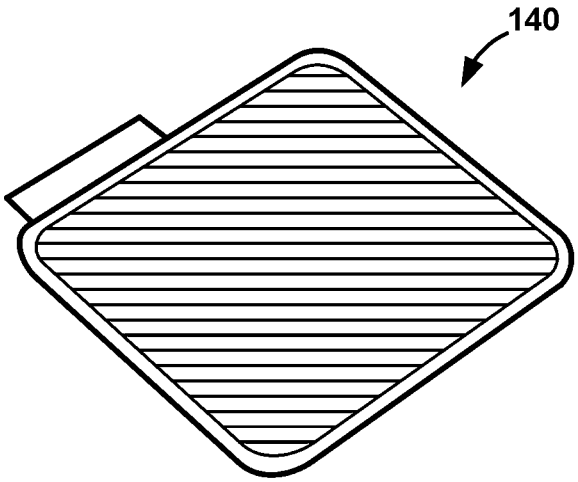
FIG. 21 shows a second configuration of the touch pad.
Figure 22:
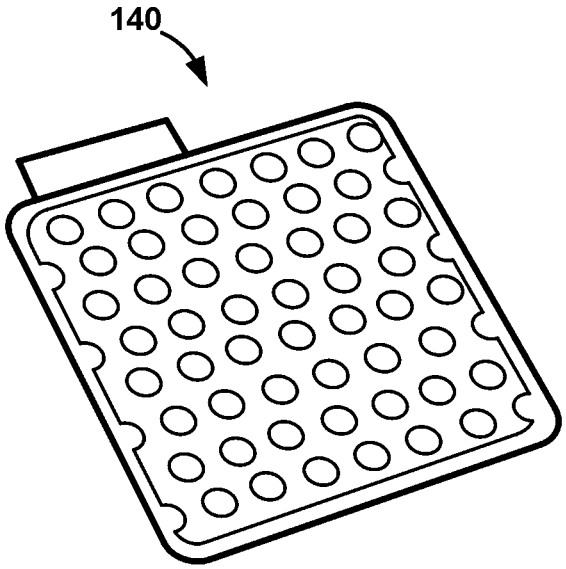
FIG. 22 shows a third configuration of the touch pad.
Figure 23:
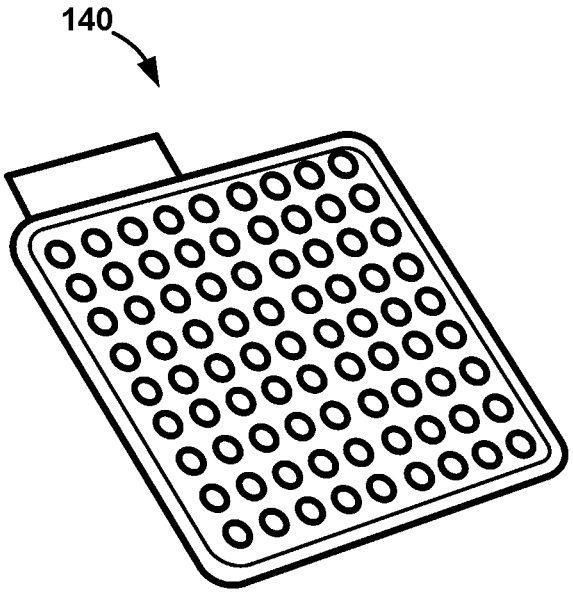
FIG. 23 shows a fourth configuration of the touch pad.
Figure 24:
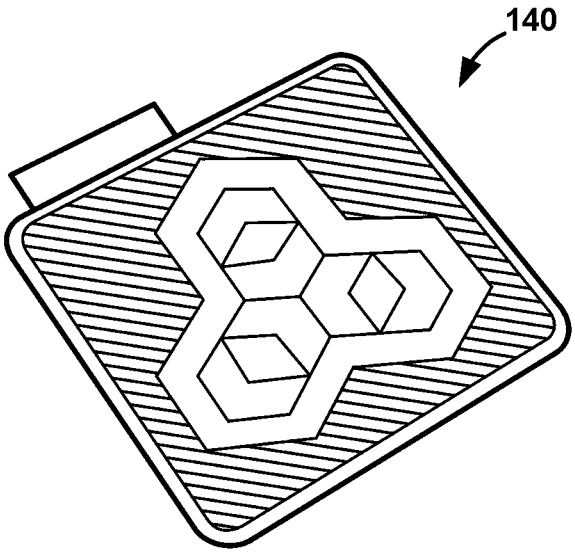
FIG. 24 shows a fifth configuration of the touch pad.
Figure 25:
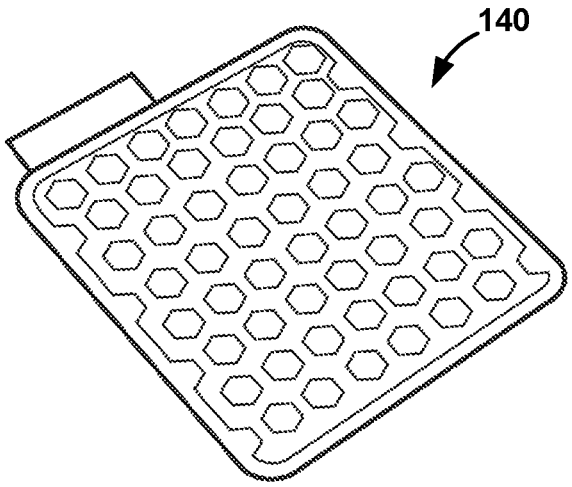
FIG. 25 shows a sixth configuration of the touch pad.

Optionally, the hinge plates 62 are molded to define an arcuate end point 84 for a distal end of the rod 65, as shown in FIG. 19, and the rod 68 has a corresponding curved distal end so as to reduce wear and minimize movement of the rod 68 in use.

By having a configuration of sprung hinges 60 at opposed corners 26 with three rods 68, an identical arrangement can be provided at both of the corners 26, thereby reducing manufacturing costs.

Preferably, an inner face 78 of the hinge plate 62 has a channel or plurality of channels 80 for receiving each rod 68. The channel 80 may be defining by guiding portions that receive at least part of the rod 68, or a tube through which the rod 68, or part of the rod passes. In this way the rods 68 can be easily inserted during assembly and can be removed and replaced if necessary.

Ideally, the sprung hinge 60 is attached to side panels 30 at the top end of the side corners 26 so as to be fixed in position to best open the box 10 when the fastener 100 is released. It is appreciated that the hinges 60 may be covered by the flexible material of the sides 14, 16 so that the hinges 60 and rods 68 are not visible in use. Preferably, the hinges 60 are accessible even when within the cover 18. For example, an opening may be provided in the cover 18 so that the hinges 60 and rods 68 can be accessed for repair or replacement.

The fastener 100, shown in FIGS. 9-11, is arranged on the underside of the base 12 so that it is easily accessible to secure the box 10 in the collapsed configuration. The fastener 10 may be a clip, buckle, hook, press stud, hook and loop, or ties, typically at the end of a strap. Optionally, part of the fastener 100 is adjustable and/or has an elastic portion to allow for different amounts or size of line, a different number or size of weights, or positioning of the line, so that the box 10 can be easily closed.

In the illustrated design, the fastener 100 is a strap 102 sewn to the base 12 with a G-clip 104 that can be connected to a selected loop 106. The selection of loops 106 enables the G-clip to be secured at different positions depending on the arrangement and amount of line and weight(s).

Optionally, an outer face of the box 10, when in the collapsed configuration, may include a tab with a hole for connection to a connector such as a carabiner. Where reinforcing webbing is used, the webbing may be extended to form the tab with hole for connection, or to form a loop as a carry handle. In this way the box 10 can be easily attached to a user prior to use.

Optionally, the outer face 116 of the base 12 and/or outer face 138 of the sides 14, 16 has touch pads 140 which direct a user to holding locations for deployment and holding locations for closure where these touch pads 140 denote the pinch points where a user applies force to collapse the box 10 by overriding the torsion spring(s) 66. Optionally, the base has two touch pads 140 that, when in the collapsed configuration, indicate a holding position. The touch pads 140 are ideally formed from a grippy material, such as a textured rubber or silicone, so that a user can easily and securely hold the box 10 prior to collapsing. Optionally, the touch pads 140 have a textured surface for grip. FIGS. 20-25 show examples of touch pads 140. Each illustrated touch pad 140 has a different textured surface pattern.

In order to effectively use the box 10 of the present invention, the throwline needs to be stored in a coiled manner to allow for tangle free deployment. With the box 10 in the deployed configuration, where the sides 14, 16 are vertical, the coiled throwline is placed on the base 12 and the throw weight(s) is placed in a throw weight pouch 120. The sides 14, 16 are folded down as described above, until the sides 14, 16 are parallel to the base, thereby covering and securing the throwline and throw weight(s).

Once all the sides 14, 16 are folded down, the vertical folds 32 of the perpendicular sides 14 are parallel to and aligned with spine 22. The box 10 can be folded in half at the spine 22 and vertical folds 32. At this point, the fastener 100 is engaged to lock the box 10 in the collapsed configuration. The box 10 can be stowed and carried in the collapsed configuration while the throwline remains flat and untangled.

When the fastener 100 is disengaged to release the box 10, the sprung hinges 60 automatically unfold the box 10 to the deployed configuration.

Thus, it has been shown and described n automatically opening throwline box. Since certain changes may be made in the present disclosure without departing from the scope of the present invention, it is intended that all matter described in the foregoing specification and shown in the accompanying drawings be interpreted as illustrative and not in a limiting sense.

The invention claimed is:

1. An automatically opening box comprising:

(a) a rectangular base formed from two rectangular panels joined by a foldable spine;

(b) a pair of perpendicular opposed sides extending upwardly from edges of the base at base corners perpendicular to the spine and each of the perpendicular opposed sides having a vertical fold aligned with the spine, a pair of parallel opposed sides extending upwardly from edges of the base at base corners parallel to the spine, and adjacent sides connected at side corners to define an open topped box;

(c) at least two side corners include sprung hinges;

(d) both sides of one of the pairs of opposed sides having diagonal folds;

(e) the automatically opening box having two configurations, a collapsed configuration in which both pairs of opposed sides are folded down to be parallel to the base, the base is folded along the spine and vertical folds, and a fastener secures the automatically opening box in the collapsed configuration, and a deployed configuration in which the fastener is released and the sprung hinges act to deploy the sides and base.

2. The automatically opening box of claim 1 wherein each side has at least one supporting rod extending along the side from one of the sprung hinges.

3. The automatically opening box of claim 2 wherein each sprung hinge holds three supporting rods.

4. The automatically opening box of claim 3 wherein each rod is of a different length.

5. The automatically opening box of claim 1 wherein the sprung hinges include at least one torsion spring to bias the spring open.

6. The automatically opening box claim 1 wherein the pair of opposed sides with diagonal folds each have triangular panels that define the diagonal folds.

7. The automatically opening box of claim 6 further comprising a fabric cover with pockets for the panels and wherein stitching further defines the corners and folds.

8. The automatically opening box of claim 1 further comprising at least one pouch arranged on an inner surface of the box.

9. The automatically opening box of claim 1 wherein the base has feet.

10. The automatically opening box of claim 1 wherein base has at least one eyelet to provide a drainage hole.

11. The automatically opening box of claim 10 wherein the eyelet operates as a foot.

12. The automatically opening box of claim 1 further comprising at least one touch pad.

13. The automatically opening box of claim 1 further comprising reinforced webbing.

* * * * *